US007954285B2

(12) United States Patent
Taylor et al.

(10) Patent No.: US 7,954,285 B2
(45) Date of Patent: Jun. 7, 2011

(54) METHOD OF INFILTRATION AND IMPACT RESISTANT CONSTRUCTION FOR GLAZING IN A BARRIER

(75) Inventors: Gregory R. Taylor, Cantonment, FL (US); Mark R. Barrow, Milton, FL (US); Randy Gardner, Pensacola, FL (US); Charles A. Haba, Massillon, OH (US); Dwayne J. Kornish, Navarre, OH (US)

(73) Assignee: Overhead Door Corporation, Lewisville, TX (US)

( * ) Notice: Subject to any disclaimer, the term of this patent is extended or adjusted under 35 U.S.C. 154(b) by 253 days.

(21) Appl. No.: 12/151,389

(22) Filed: May 6, 2008

(65) Prior Publication Data

US 2009/0277109 A1 Nov. 12, 2009

(51) Int. Cl.
*E06B 3/00* (2006.01)

(52) U.S. Cl. ..... 52/208; 52/204.53; 52/204.62; 52/204.7

(58) Field of Classification Search ..... 52/204.53, 52/204.591, 204.62, 204.7, 208, 745.19
See application file for complete search history.

(56) References Cited

U.S. PATENT DOCUMENTS

| | | | | |
|---|---|---|---|---|
| 3,382,630 | A * | 5/1968 | Chivers | 52/208 |
| 5,722,206 | A | 3/1998 | McDonald | 52/202 |
| 6,026,886 | A | 2/2000 | Diamond-Martinez | 160/113 |
| 6,698,145 | B2 * | 3/2004 | Berger, Jr. | 52/208 |
| 6,708,458 | B1 | 3/2004 | Berger, Jr. | 52/204.54 |
| 6,715,245 | B2 | 4/2004 | Lewkowitz | 52/208 |
| 6,837,011 | B2 | 1/2005 | Berger, Jr. | 52/204.62 |
| 6,862,850 | B2 | 3/2005 | Berger, Jr. | 52/204.6 |
| 6,978,579 | B1 * | 12/2005 | Trinca | 52/203 |
| 7,107,736 | B2 | 9/2006 | Barnard | 52/745.15 |
| 2004/0154242 | A1 | 8/2004 | Hudoba et al. | 52/202 |

* cited by examiner

*Primary Examiner* — Brian E Glessner
*Assistant Examiner* — Patrick Maestri
(74) *Attorney, Agent, or Firm* — Renner Kenner Greive Bobak Taylor & Weber

(57) ABSTRACT

A glazing system for use with a barrier that has a panel with an opening is disclosed. An impact glazing, which covers the opening, includes an inner surface and an outer surface and a plurality of apertures around its periphery. A fastener having a fastener head passes through each corresponding aperture and into the panel. The glazing system also includes an elastically deformable washer positioned between each fastener head and the impact glazing. The glazing system may also include an inner bezel covering the periphery of the glazing on the inner surface and an outer bezel covering the periphery of the glazing on the outer surface, wherein the bezels are secured to the barrier and the glazing by a corresponding piece of adhesive tape.

19 Claims, 7 Drawing Sheets

METHOD OF INFILTRATION AND IMPACT RESISTANT CONSTRUCTION FOR GLAZING IN A BARRIER

TECHNICAL FIELD

One or more embodiments of the present invention relate to a glazing system for a barrier. Specifically, one or more embodiments of the present invention relate to an impact, water, and air infiltration resistant glazing system for a barrier, such as a garage door.

BACKGROUND ART

Extreme weather-created phenomenon, such as hurricanes, typhoons, tornadoes, or the like can often cause damage to building structures. Such storm-related damage frequently occurs when high winds, and/or debris carried thereby, invade the structure through its weakest points, typically its window or door openings. Once invaded, the structure is vulnerable to further damage to the structure's interior. In geographic areas susceptible to frequent violent weather conditions, it is important to prevent such storm related damage to a structure by providing impact and infiltration resistant coverings in the openings, or by providing separate protective structures.

Traditionally, home or building owners, if alerted to an oncoming storm, cover these portions of their structures by nailing plywood or other boards over them. However, this "boarding up" procedure is not only time consuming, when time is usually of the essence, but can also disfigure the exterior of the structure upon the frequent installation and removal of the boards. In addition, the plywood or other boards are not only heavy and cumbersome to move, but also they will eventually deteriorate, and after frequent use, their fastening points are no longer effective. Moreover, storing or maintaining an inventory of the boards can take up a great deal of space which would otherwise be usable for other purposes.

One area of particular concern in storm events is movable barriers such as garage doors. The strength of the barriers can be improved by adding struts to the garage door's sectional panels, or by deploying a vertical structural post system to protect the barrier in advance of the storm. However, these improvements do not address garage doors which provide windows. Protection of such windows is often overlooked when preparing for a storm. In response to this need, glazing systems have been developed which strengthen the windows or glazing provided in the door or the door's sectional panels.

The use of polycarbonate sheets as window coverings is well known in the art. This material is advantageous due to its impact resistant properties. However, the methods used to attach the polycarbonate sheet over the window openings have thus far proven problematic as the attachment mechanisms often cause the sheet to deform and become dislodged from a clamping type assembly designed to secure it in place. Alternatively, where through-bolts are used as attachment mechanisms, the polycarbonate sheet often fractures over time due to stresses created by the bolts and the inability of the polycarbonate sheet to move due to thermal and mechanical expansion and contraction from temperatures and wind pressures.

Thus, the need exists for a system to protect openings in a barrier which does not suffer the problems discussed above.

SUMMARY OF THE INVENTION

In light of the foregoing, it is a first aspect of the present invention to provide a method of infiltration and impact resistant construction for glazing in a barrier.

Another aspect of the present invention is to provide a glazing system for a barrier comprising a panel having an opening therethrough, an impact glazing having a plurality of apertures extending therethrough and positioned around a periphery thereof, the impact glazing disposed over the opening, a plurality of fasteners having fastener heads, each fastener passing through a corresponding one of the apertures and into the panel, and a plurality of elastic washers, each washer positioned between a corresponding one of the fastener heads and the glazing.

Yet another aspect of the present invention is to provide a glazing system for a barrier comprising a panel having an opening therethrough, an impact glazing having an inner surface and an outer surface and a plurality of apertures extending therethrough and positioned around a periphery thereof, the impact glazing disposed over the opening, a plurality of fasteners having fastener heads, each fastener passing through a corresponding one of the apertures and into the panel, and an inner bezel covering the periphery of the impact glazing on the inner surface and an outer bezel covering the periphery of the glazing on the outer surface, wherein adhesive seals are provided between the inner bezel and the panel adjacent the outer periphery of the inner bezel, and between the outer bezel and the outer surface of the impact glazing adjacent an inner periphery of the outer bezel.

Still another aspect of the present invention is to provide a method of constructing a glazing system in a barrier comprising providing a panel with an opening therethrough, positioning an impact glazing, which has an inner surface and an outer surface and a plurality of apertures around its periphery, over the opening, securing the impact glazing to the panel in the opening with fasteners, each fastener extending through a corresponding aperture, each fastener having a fastener head, wherein an elastic washer is positioned between each fastener head and the impact glazing, securing an inner bezel over the periphery of the inner surface of the impact glazing using an adhesive tape positioned between the outer periphery of the inner bezel and the barrier, and securing an outer bezel over the periphery of the outer surface of the impact glazing using another adhesive seal positioned between the inner periphery of the outer bezel and the outer surface of the impact glazing.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
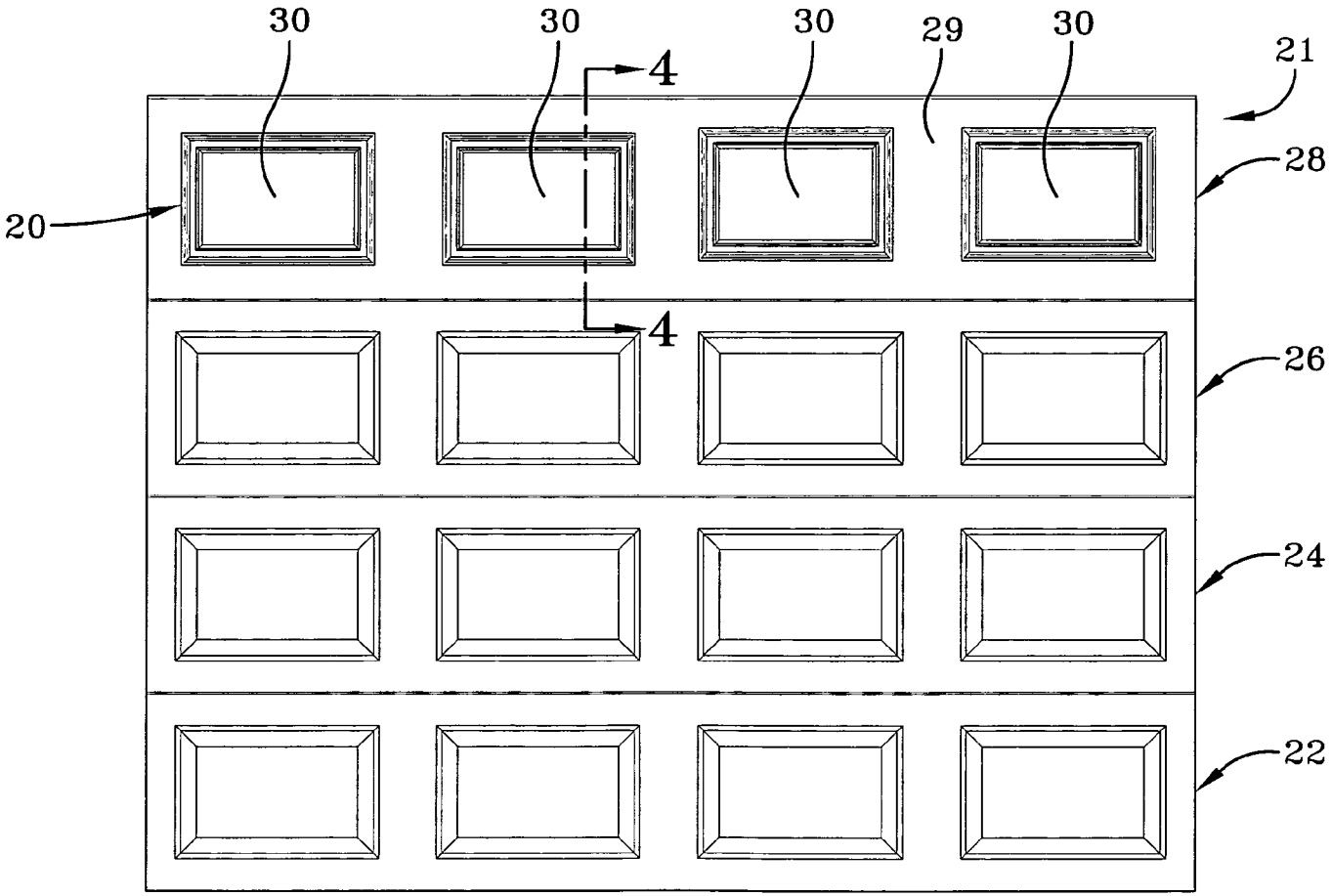
FIG. 1 is a front view of a barrier incorporating a glazing system according to the concepts of the present invention, wherein the barrier may be insulated or non-insulated.

An exemplary glazing system according to the concepts of the present invention is generally indicated by the numeral 20 in the drawings. The glazing system 20 is shown mounted in conjunction with a movable barrier such as a sectional overhead door, generally indicated by the numeral 21, of a type employed in garages for homes. It will be appreciated, however, that the glazing system 20 can readily be adapted for use in a wide variety of residential and commercial barriers used in building openings. And although a sectional door is shown, it will be appreciated that the glazing system could be used with a one-piece door. In any event, the door 21 is supported and moved in any number of ways known in the art.

Sectional door 21 consists of four hingedly interconnected panels, including a bottom panel 22, a lower intermediary panel 24, an upper intermediary panel 26, and a top panel 28, although more or less panels may be used. The top panel 28 will also be referred to as an insulated door panel 28, but as will be described, the system 20 can be incorporated into non-insulated panels.

Multiple glazing systems 20 are mounted in openings within top panel 28, and in this case four glazing systems 20 are shown. Although an exemplary embodiment is shown in the Figures in which glazing systems 20 are mounted only in a top panel 28, glazing systems 20 may be mounted in openings in more than one sectional door panel, or in panels other than top panel 28. For example, glazing systems 20 may be mounted in one or more openings in top panel 28 as well as upper intermediary panel 26, or only in upper intermediary panel 26. Those panels not having glazing systems disposed therein may include raised embossments as is known in the art. The panel 28 has an outer facing surface 29 which is viewable from the building's exterior.

Figure 2:
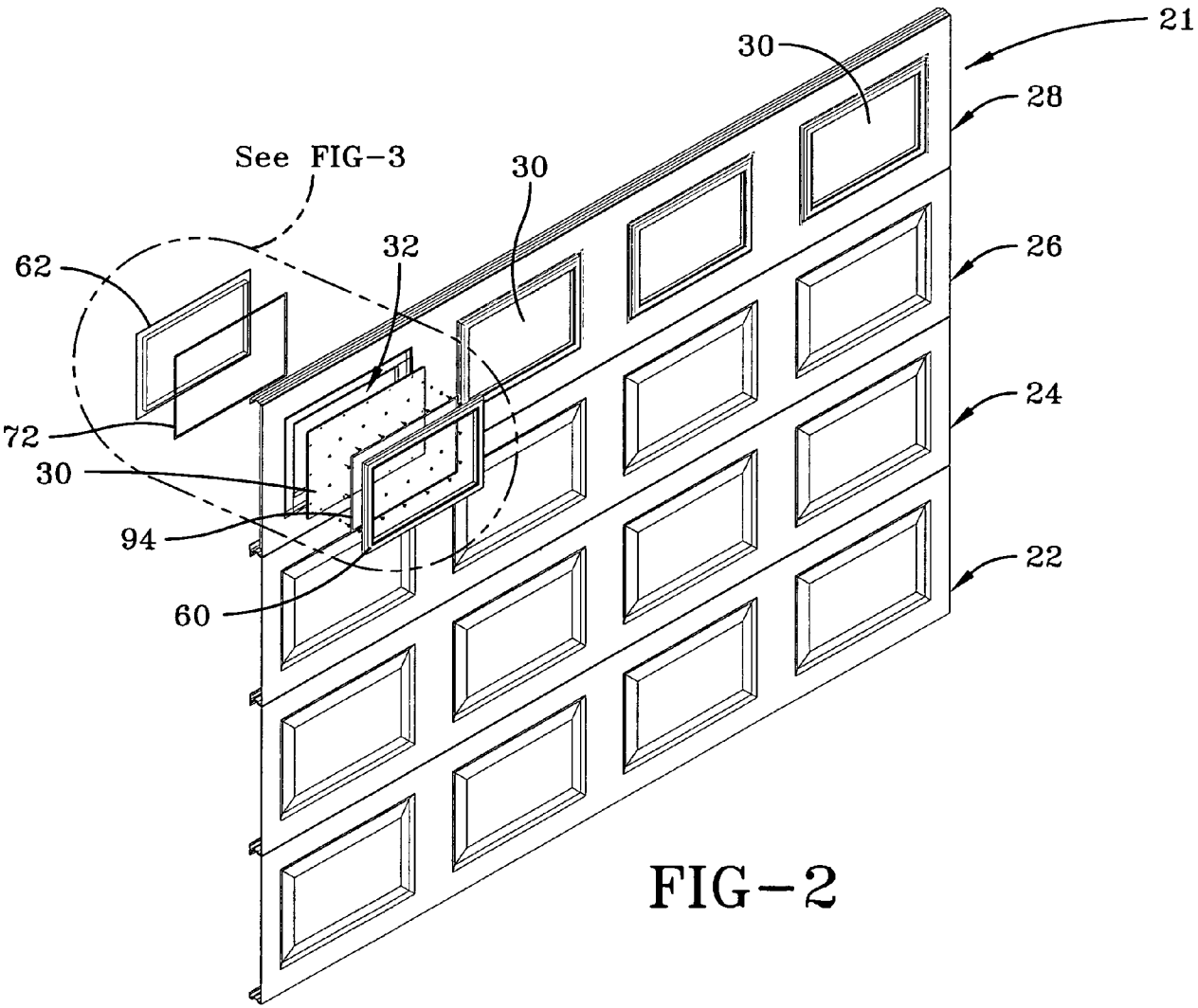
FIG. 2 is a perspective view of the barrier of FIG. 1 with the glazing system in an expanded and unassembled state.
Figure 3:
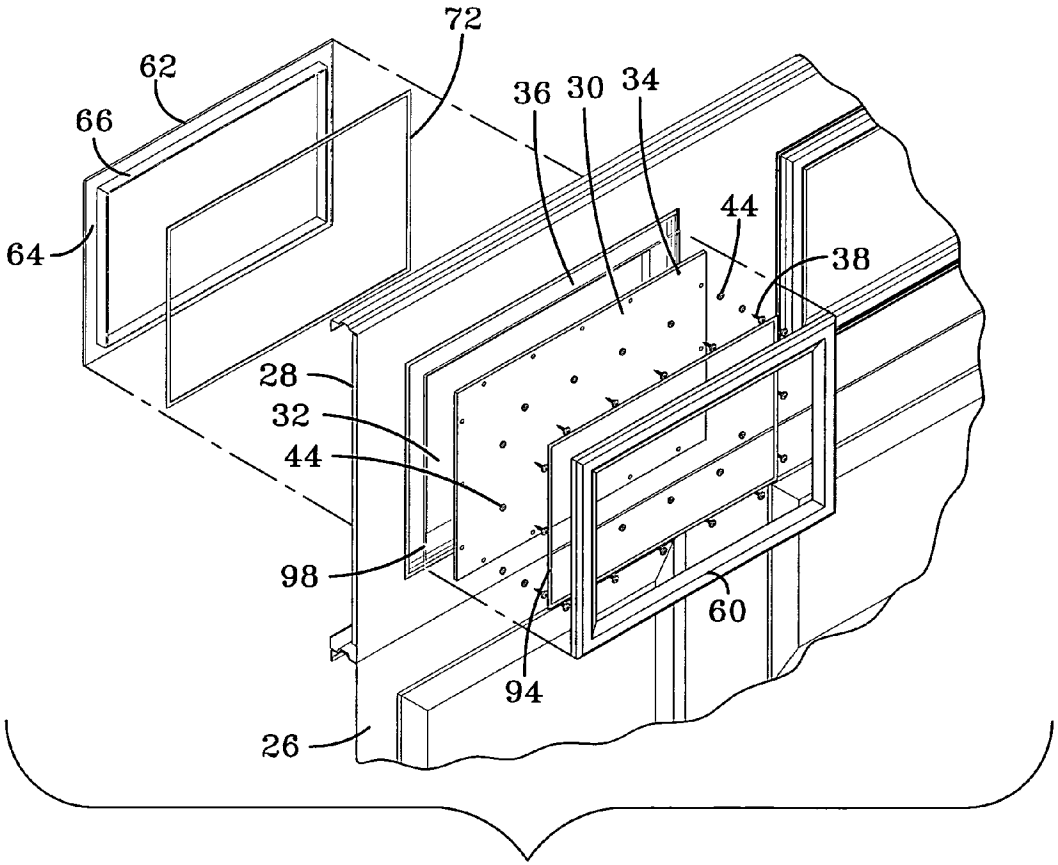
FIG. 3 is a close-up perspective view of the glazing system as in FIG. 2.
Figure 8:
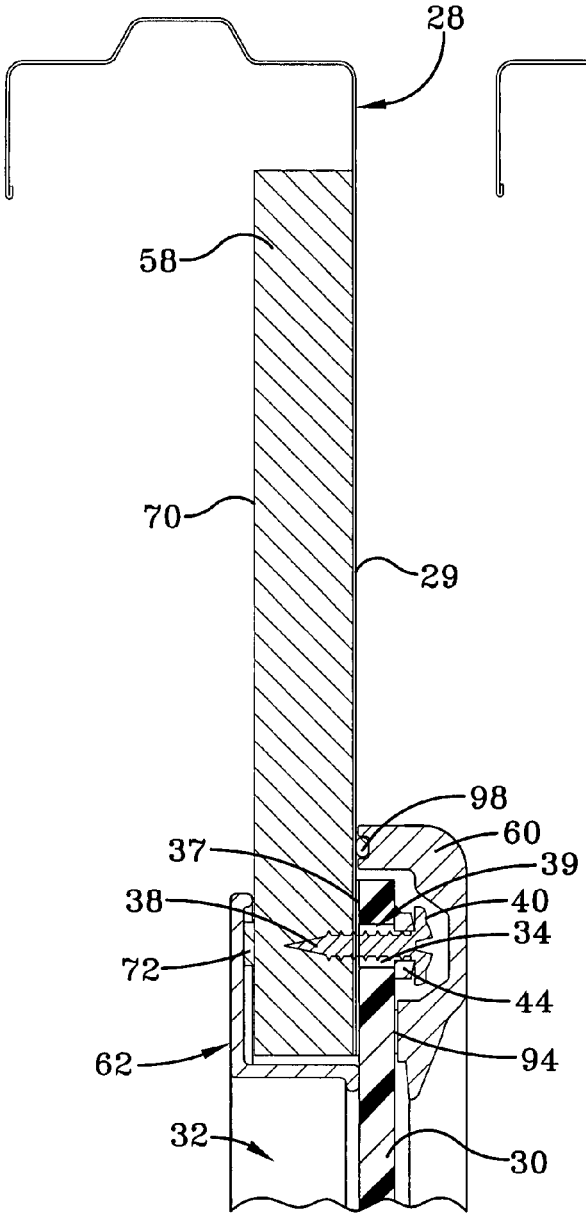
FIG. 8 is a detailed view, in cross-section, of an alternative embodiment.
Figure 9:
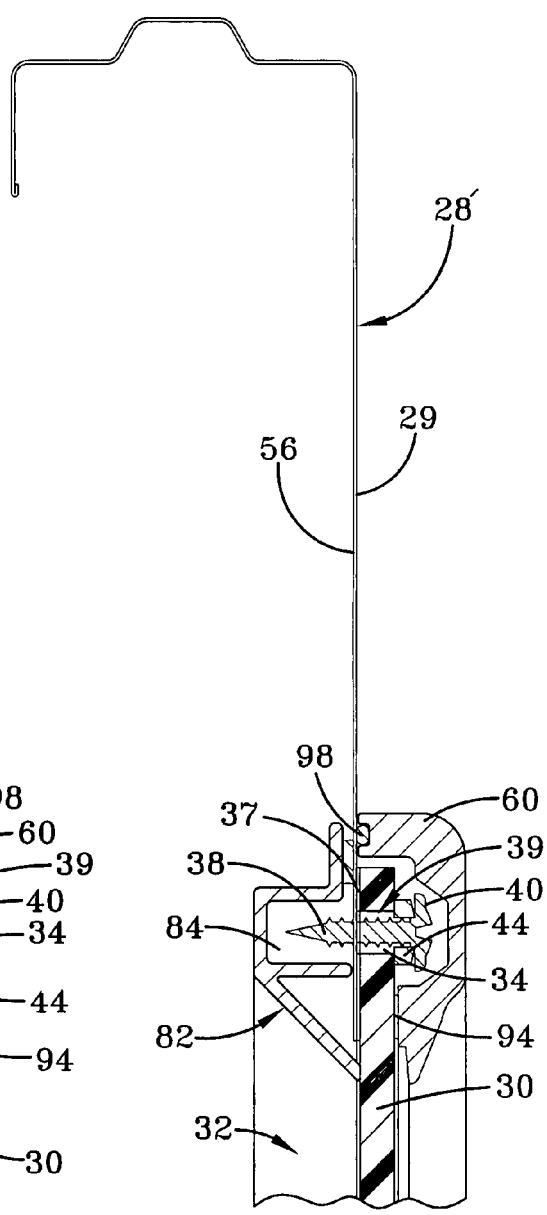
FIG. 9 is a detailed view, in cross-section, of another alternative embodiment.
Figure 10:
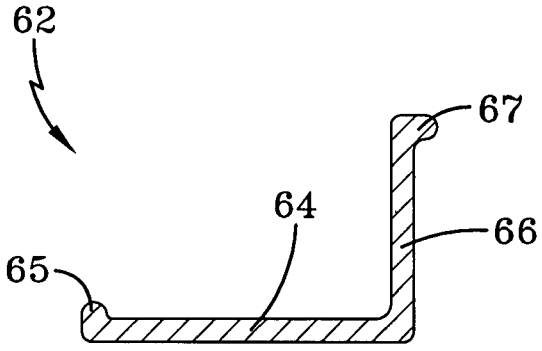
FIG. 10 is a cross-section view of a first embodiment of an inner bezel as seen in FIGS. 4, 6 and 8.
Figure 11:
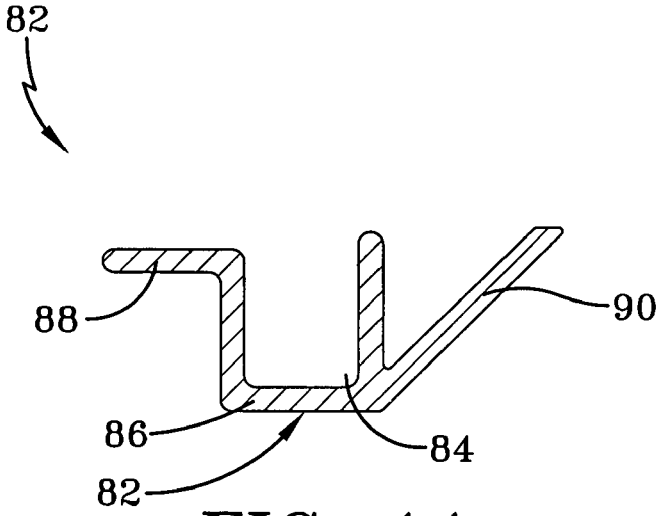
FIG. 11 is a cross-section view of a second embodiment of an inner bezel as seen in FIGS. 5, 7 and 9.
Figure 12:
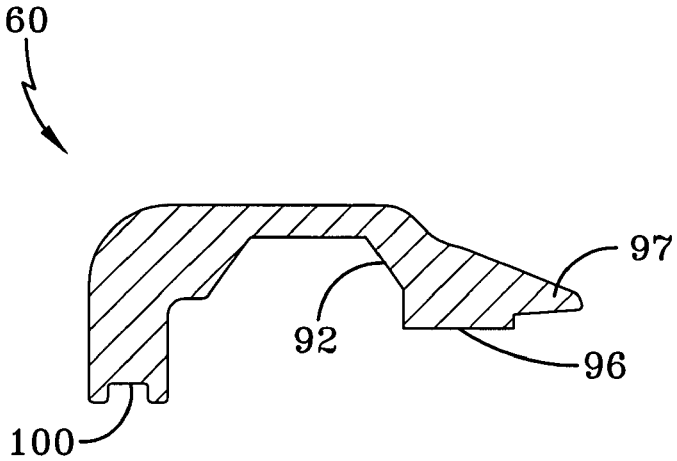
FIG. 12 is a cross-section view of an outer bezel according to the concepts of the present invention.

As best seen in FIGS. 2 and 3, the panel 28 has an opening 32 extending therethrough. The opening is formed by punching or cutting the panel. Formation of the opening also modifies the panel so as to form a recess 36 that uniformly surrounds the opening 32 and is below the outer facing surface 29 of the panel. As such, in most embodiments, the recess 36 is dimensionally the same from an edge that forms the opening to an edge that is contiguous with the surface 29. The recess 36 may be partially flat and partially contoured as shown in FIGS. 4-7, or in some embodiments the recess may be entirely flat. And in some embodiments as shown in FIGS. 8 and 9, a recess is not provided at all.

The glazing system 20 includes an impact glazing 30 positioned over the opening 32 in top panel 28. The impact glazing 30 is supported on its edges by the recess 36 so that a planar exterior surface 48 of the glazing sits substantially flush with the facing surface 29 of sectional door 21, while covering the opening 32. Indeed, all sides of glazing 30 overlap the recess 36 by approximately 0.5 to 2.5 inches and in most embodiments by about 1.0 inch. In other words, a perimeter of the glazing 30, ranging anywhere from about 0.5 inches to about 2.5 inches from an outer edge of the glazing inward, is supported by a flat portion of the recess 36. In most embodiments, the size of dimensional support is substantially the same around the glazing's entire perimeter.

Impact glazing 30 includes a plurality of apertures 34 that extend therethrough and that are positioned around its periphery. Apertures 34 are uniformly spaced about the periphery of glazing 30, and have a uniform size. The specific number of apertures 34 provided in impact glazing 30 is not critical; however, sufficient apertures are needed to allow impact glazing 30 to be securely attached to the door panel such that glazing system 20 is capable of withstanding increased wind and impact forces. In one embodiment, apertures 34 are uniformly spaced at intervals of between approximately 3.5 to approximately 4.25 inches apart around the periphery of impact glazing 30, although other spacing intervals could be used. Impact glazing 30 may be made of any suitable material known to persons skilled in the art, including metal, composite materials, polymeric materials, and laminates, although in most embodiments, impact glazing 30 is made of polycarbonate due to its known impact resistant characteristics. In addition, impact glazing 30 may be clear, tinted, or opaque depending upon the desired appearance and should have a thickness of at least about 0.20 inches, although any reasonable thickness could be used.

Prior to installing the glazing 30 over the opening 32, a structural sealant 37 is applied around a perimeter of the glazing at the apertures. The structural sealant 37 may be a caulk-type adhesive or any compatible adhesive that securely bonds the material of the glazing to the material of the panel. The structural sealant 37 may slightly fill into each of the apertures. A compressive force is applied to glazing until it is secured to the panel.

A fastener 38 is inserted through each aperture 34 and into top panel 28, and specifically the recess 36 of panel 28, to further secure impact glazing 30 over opening 32. The fasteners 38 are selected with attributes—thread pitch, threads per inch, head size, etc.—so that secure attachment may be made to the panel 28 which may be constructed of metal or a suitably rigid or semi-rigid plastic. Fasteners 38 may be any conventional threaded fastener having a head 40 known to those skilled in the art. For example, fasteners 38 as shown in the figures are threaded, self-piercing stainless steel screws having a Phillips head 40 to facilitate driving the fasteners into top panel 28 during installation. The screws are approximately 0.75 inches long and have an outer thread diameter of approximately 0.170 inches. The outer thread diameter of fasteners 38 is less than the diameter of apertures 34 so that when fasteners 38 are positioned within apertures 34 there is a circumferential gap 39 between the fastener and the glazing material that defines the aperture. The gaps around fasteners 38 allow impact glazing 30 to expand and contract due to natural thermal cycles, and to slightly move due to high wind forces, without fracturing or creating stresses that may ultimately lead to failure of impact glazing 30. It will also be appreciated that structural sealant 37 that fills into apertures 34 surrounds the fasteners 38 at the panel surface interface to prevent water and air infiltration through the aperture while still permitting expansion and contraction of the glazing. The sizing of the apertures is very much dependent on the type and thickness of the glazing 30 and on any desired attributes of the fasteners. At a minimum, there is at least a discernable gap 39 between the fastener's outer diameter and the glazing material, although any reasonably sized gap could be provided. In selected embodiments, apertures 34 have a diameter that is between approximately 1.4 to 1.6 times the outer thread diameters of fasteners 38. In most embodiments, apertures 34 have a diameter that is approximately 1.5 times the outer thread diameter of fastener 38.

In order to further secure glazing 30 over opening 32 without restricting its ability to expand, contract, and to move as discussed above, elastomeric washers 44 are provided around fasteners 38 between fastener heads 40 and glazing 30. Washers 44 are made of a resilient material to allow absorbance of shock from repeated impacts on the glazing. When fasteners 38 are driven into recess 36 to secure glazing 30 over opening 32, fastener heads 40 tighten over elastically deformable washers 44 without imparting significant stresses on glazing 30. In this way glazing 30 may be adequately secured over opening 32 so as to be able to withstand increased wind forces, without restricting its ability to expand and contract when necessary. Elastomeric washers 44 may be made of any suitable material with elastomeric properties known to persons skilled in the art, such as one of many available rubber, thermo-elastic, or thermoplastic elastomer compositions. Use of elastomeric, resilient washers significantly reduces or eliminates cracking of the glazing that would otherwise be encountered. Skilled artisans will appreciate that a more resilient washer material will require more application of force to tighten the fastener to the panel. Elastomeric washers 44 have an inner diameter slightly greater than the outer thread diameter of fasteners 38 so that they can fit around the fasteners, and an outer diameter that is greater than the diameter of apertures 34 so that they are not forced therethrough when pressure is applied by fastener heads 40. In most embodiments, elastomeric washers 44 have an outer diameter that is approximately 1.5 times the diameter of apertures 34.

Figure 4:
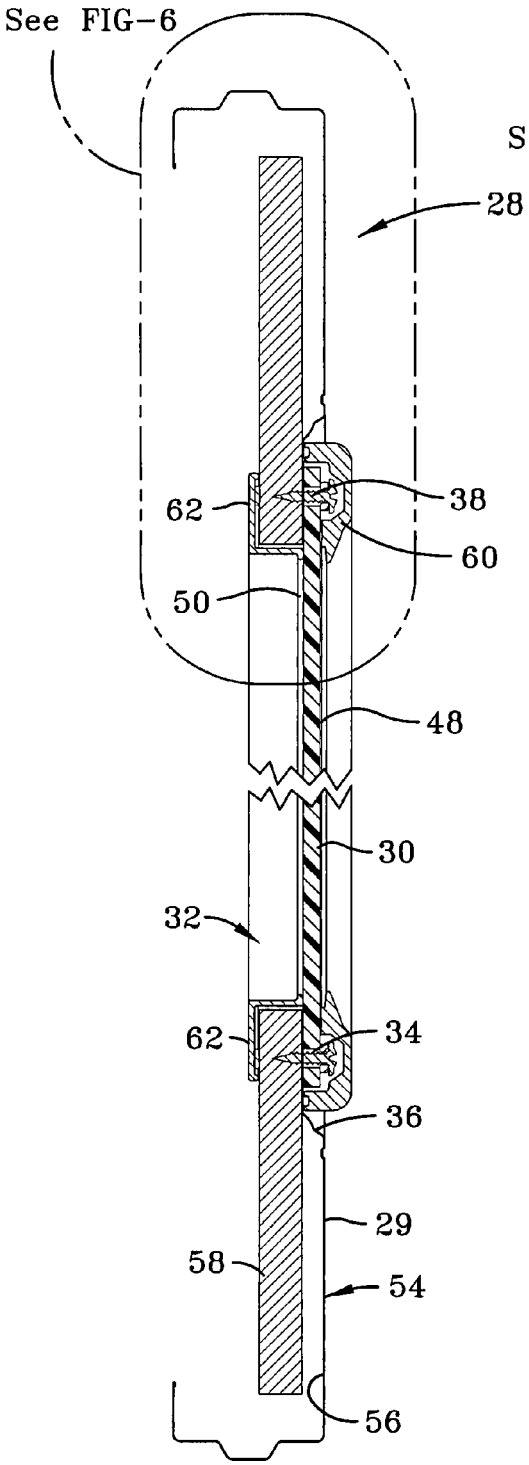
FIG. 4 is a cross-section view taken across line 4-4 of FIG. 1 of an insulated barrier having the glazing system of the present invention.
Figure 5:
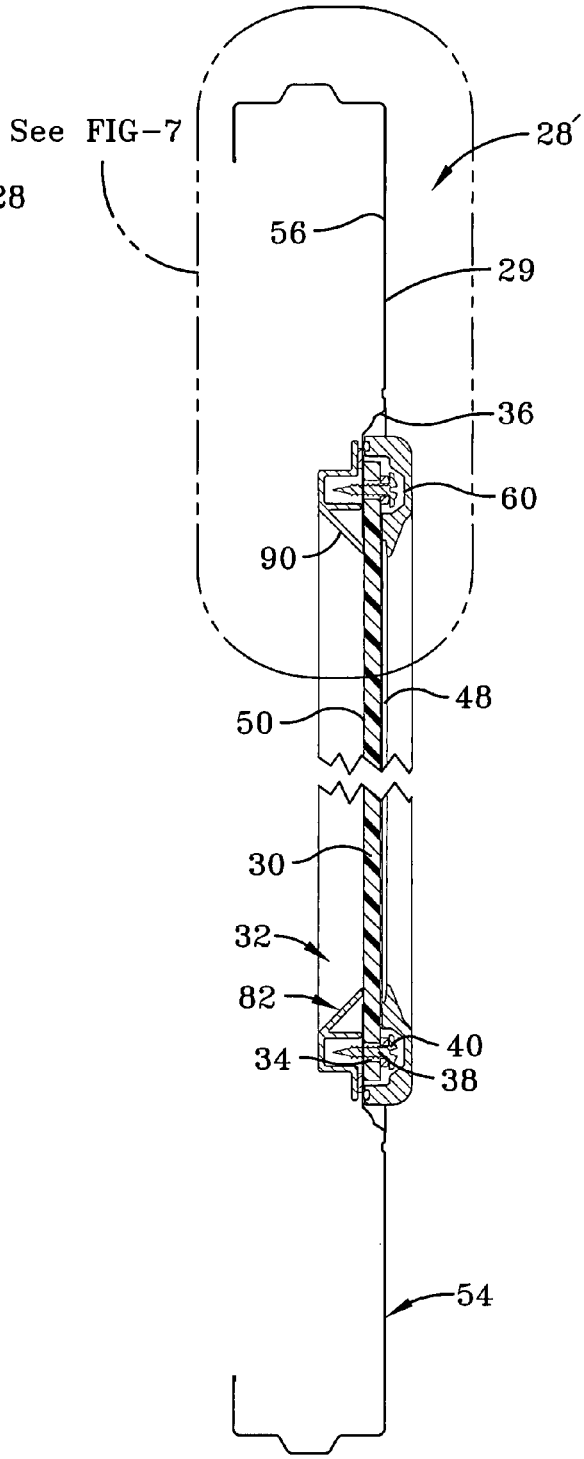
FIG. 5 is a cross-section view taken across line 4-4 of FIG. 1 of a non-insulated barrier having the glazing system of the present invention.
Figure 6:
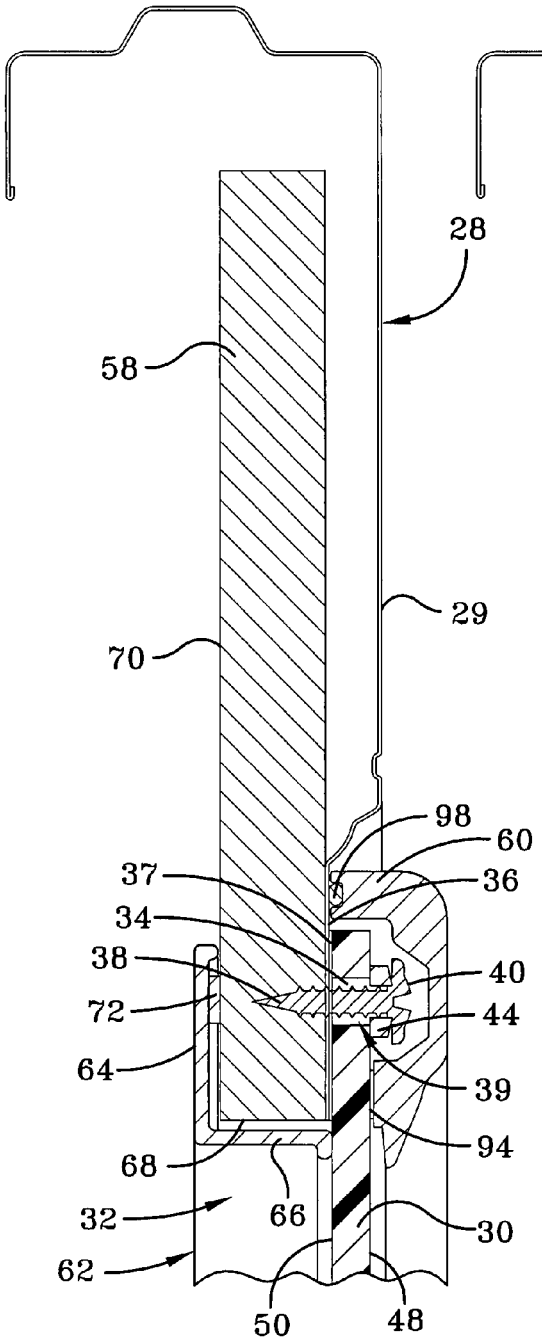
FIG. 6 is a detailed view of a portion of the cross-section of FIG. 4.
Figure 7:
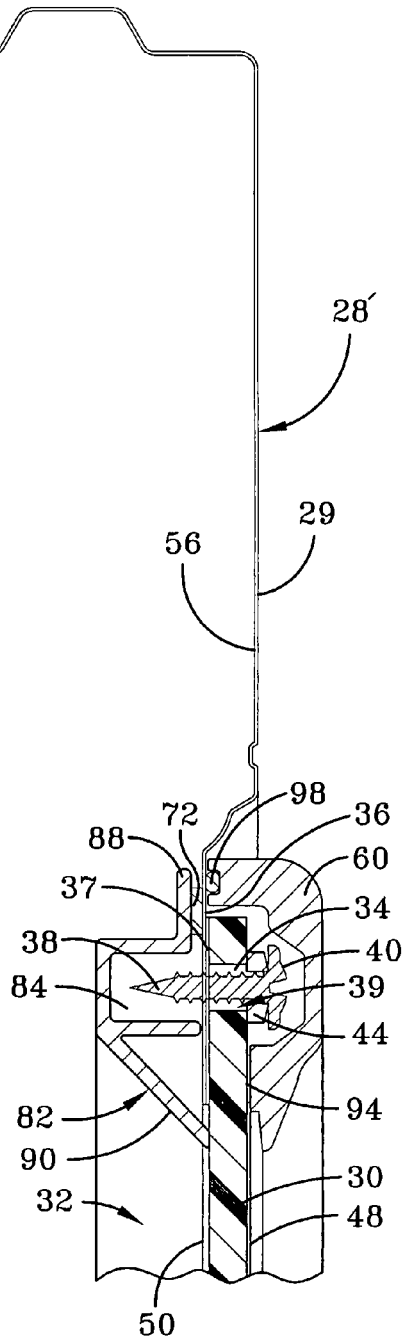
FIG. 7 is a detailed view of a portion of the cross-section of FIG. 5.

The glazing system of the present invention may be installed in both insulated barriers, as best seen in a first embodiment of the glazing system 20 shown in FIGS. 4 and 6, and in non-insulated barriers, as best seen in a second embodiment of the glazing system 20 shown in FIGS. 5 and 7. The glazing system 30 may also be installed over openings of insulated and non-insulated panels that do not provide a recess as shown in FIGS. 8 and 9. By not providing a recess, the glazing system 20 extends notably from the face of the panel. The glazing system of the insulated and non-insulated panels, with or without a recess, are substantially identical in all respects except for an inner bezel provided around the periphery of glazing 30 on the inner side of top panel 28 or panel 28'. In all embodiments, structural sealant 37 and fasteners 38 secure glazing 30 where the fasteners enter at the exterior surface 48, passing through apertures 34, and exiting apertures 34 at an inner surface 50 of the glazing before penetrating the recess 36 or the panel. Thus, fastener heads 40 are positioned adjacent the washers 44 which are positioned adjacent the exterior surface 48 when glazing system 20 is assembled. By assembling glazing system 20 in this manner, some of the forces acting against glazing 30 are absorbed into the panel, thereby reducing the stresses acting on glazing 30. Moreover, due to the over-sizing of the apertures 34 with respect to the fasteners 38, movement of the glazing by wind forces or thermal variations minimizes unwanted forces imparted by the fasteners on the glazing. It should be appreciated, however, that recess 36 may extend outwardly from surface 29 instead of inwardly or flush, and fasteners 38 and washers 44 may be inserted through the glazing in the opposite direction from that explained above without deviating from the scope of the present invention.

Glazing system 20 may be installed in an insulated door panel 28, or other insulated barrier, as seen in FIGS. 4, 6 and 8. Insulated door panel 28 includes a facer 54, which has the outer facing surface 29 that is opposite an inner facing surface 56, and an insulated core 58 that is secured to the inner facing surface 56. The insulated core 58 may be in the form of a foam block adhered to the surface 56 as shown, or the core may be a foam material that is formed in-situ in a manner well known in the art. For the insulated barrier embodiments, it will be appreciated that the foam material extends along the entire interior facing surface 56 and that a rear facer will be employed to contain the foam material. In such an embodiment, opening 32 extends all the way through the rear facer. Glazing 30 is installed in insulated door panel 28 as discussed above, with structural sealant 37 and fasteners 38 extending through apertures 34, facer 54, and into foam core 58. An outer bezel 60 is positioned over fasteners 38 and around the periphery of outer surface 48 of glazing 30, as will be discussed in greater detail below.

An inner bezel 62 is positioned over the periphery of the inner surface 50 of glazing 30. As is evident from FIGS. 4, 6 and 8, inner bezel 62 is substantially L-shaped, having a first portion 64 with an extending nub 65 positioned proximate an inner surface 70 of core 58, and a second portion 66, with an extending nub 67, that extends in a direction substantially perpendicular to first portion 64 into opening 32.

Inner bezel 62 is attached to the core's inner surface 70 by a double sided adhesive tape 72. In place of tape 72, dispensed gasket sealant, adhesive or any compatible equivalent may be used. Inner bezel 62 extends around the entire periphery of opening 32 and thus provides a decorative and aesthetically pleasing trim on the interior surface of panel 28. The inner bezel 62 is sized to snugly fit within the opening 32. The core 58 includes an edge surface 68 which, along with an inner edge of the recess 36, forms the opening 32. One side of the tape 72 or selected adhesive material is positioned to adhere to the portion 64 and the other side of the tape adheres to the inner surface 70. The nub 65 provides a sealing contact against the core. The portion 66 is sized to abut or be adjacent to the edge surface 68 and the inner edge of recess 36 in such a manner that the nub 67 provides a sealing contact against the surface 50.

Glazing system 20 may also be installed in a non-insulated door panel 28', or other non-insulated barrier, as previously indicated, and as seen in the second embodiment of the invention shown in FIGS. 5, 7 and 9. This second embodiment of the glazing system is substantially the same as the first embodiment discussed above except for several differences between the inner bezels and the panel. Accordingly, like features of the two embodiments are identified by like numerals in the figures. Non-insulated door panel 28' includes a facer 54 with a recess 36 that forms the opening 32. Impact glazing 30 is secured in recess 36 over opening 32 in panel 28' with fasteners 38 and structural sealant 37 as previously discussed. Due to the lack of insulation on the inner surface 56 of facer 54, fasteners 38 protrude therethrough and are exposed. The exposed fasteners 38, if left uncovered, are unsightly and may create a dangerous condition on the inner surface 56 of the barrier. To remedy the dangerous condition created by the exposed fasteners 38, an inner bezel 82, as best seen in FIG. 9, is provided with a channel 84 for receiving and covering the exposed ends of fasteners 38. Channel 84 is defined by a body 86 of inner bezel 82, body 86 having a generally U-shaped cross section with its open end facing inner surface 56 of facer 54. Inner bezel 82 further includes a flange 88 extending substantially perpendicularly from the outer end of body 86, and a support portion 90 extending substantially diagonally from an inner corner of body 86, wherein the portion 90 has a distal end that is in sealing contact with impact glazing 30. Inner bezel 82 is attached to panel 28' by a double sided adhesive tape 72 or selected adhesive material positioned around the outer periphery of inner bezel 82 between flange 88 and inner surface 56 of panel 28' and specifically recess 36. Inner bezel 82 extends around the entire periphery of opening 32 and thus provides a decorative and aesthetically pleasing trim around the periphery of inner surface 50 of impact glazing 30, while covering the exposed portions of fasteners 38.

For both insulated and non-insulated panel embodiments, an outer bezel 60 is provided over the periphery of outer surface 48 of impact glazing 30 and an exterior surface 29 of panel 28/28', as best seen in FIGS. 6-9 and 12. Outer bezel 60 is positioned over fasteners 38 around the periphery of glazing 30, and has a channel 92 to allow fastener heads 40 to be received therein, while outer bezel 60 fits tightly against outer surface 48 of impact glazing 30 and outer surface 29 of panel 28/28'. Outer bezel 60 is secured to outer surface 48 of impact glazing 30 by double sided adhesive tape 94 positioned between the inner periphery of outer bezel 60 and the outer periphery of outer surface 48 of impact glazing 30. As with tape 72, tape 94 may be substituted by a dispensed gasket sealant, adhesive or any compatible equivalent. For this purpose, a flat portion 96 is provided on outer bezel 60 to receive one side of adhesive tape 94 or other adhesive. A lip 97 extends from the flat portion 96. Outer bezel 60 is secured by a bead seal 98 between the outer periphery of outer bezel 60 and outer surface 29 of panel 28/28'. Bead seal 98 secures outer bezel 60 to the panel, while also providing a seal against water and air infiltration through outer bezel 60 and glazing system 20. In order to better accommodate bead seal 98, a recess 100 is provided on an inner surface and around the outer periphery of outer bezel 60 such that bead seal 98 fits within recess 100. Outer bezel 60 thus provides a decorative and aesthetically pleasing trim on outer surface 29 of top panel 28/28', while covering fastener heads 40 and providing a seal against water and air infiltration. However, the primary means of sealing to prevent water and air infiltration is provided by the structural sealant 37 interface between the glazing and the panel.

Inner and outer bezels 60, 62, 82 are secured to panel 28/28' and impact glazing 30 by structural sealant, adhesive tapes and/or bead seals and without the use of fasteners. Therefore, outer bezel 60 or inner bezel 62 or 82 may be replaced in the case of damage, without removing fasteners 38 securing impact glazing 30 in opening 32. In this way, maintenance of glazing system 20 is improved and made easier. Also, a user is provided with the option of enhancing the appearance of glazing system 20 by inserting a decorative insert in a channel formed between the lip 97 and the surface 48 without having to worry about the integrity of impact glazing 30. This configuration provides circumferential seals on both the exterior and interior surfaces with respect to the panel and the glazing. On the exterior side, the bead seal 98 provides a circumferential seal between the recess and the outer bezel, and the tape 94 provides a circumferential seal between the glazing and the outer bezel. On the interior side, the tape 72 provides a circumferential seal between the recess and the inner bezel, and the support portion 90 or the nub 67 provides a contacting seal between the inner bezel and the glazing. Still another advantage of the present invention is that the over-sized fastener apertures, the structural sealant and compression washers allow the glazing to move, or expand and contract, without unduly stressing and cracking the glazing which would eventually lead to water and air infiltration.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. A glazing system for a barrier comprising:

a panel having an opening therethrough;

an impact glazing having a plurality of over-sized apertures extending therethrough and positioned around a periphery thereof, said impact glazing disposed over said opening and having an inner surface and an outer surface;

a plurality of fasteners, each fastener having a fastener head extending from a fastener shaft, each said fastener shaft passing through a corresponding one of said over-sized apertures and into said panel such that a full circumferential gap is formed between said fastener shaft and said impact glazing;

a plurality of elastic washers, each said washer positioned between a corresponding one of said fastener heads and said glazing; and an outer bezel covering the periphery of said glazing on said outer surface, said outer bezel being positioned over said fastener heads and including a channel to receive said fastener heads, wherein said outer bezel is secured to said glazing by an adhesive disposed between said outer bezel and said outer surface of said impact glazing.

2. The glazing system according to claim 1, wherein said apertures are uniformly sized and uniformly spaced about the periphery of said impact glazing.

3. The glazing system according to claim 1, wherein said apertures have a diameter that is between approximately 1.4 and approximately 1.6 times the diameter of said fastener shafts.

4. The glazing system according to claim 3, wherein said apertures have a diameter that is approximately 1.5 times the diameter of said fastener shafts.

5. The glazing system according to claim 3, wherein said washers have an inner diameter approximately equal to but greater than the diameter of said fastener shafts, and said washers have an outside diameter that is at least 1.5 times the diameter of said apertures.

6. The glazing system according to claim 1, wherein said impact glazing has an inner surface and an outer surface, and wherein said fasteners pass through said impact glazing from said outer surface such that said fastener heads are positioned proximate said outer surface of said glazing.

7. The glazing system according to claim 1, wherein said impact glazing is made from polycarbonate.

8. The glazing system according to claim 1, further comprising:

an inner bezel covering the periphery of said impact glazing on said inner surface.

9. The glazing system according to claim 8, further comprising:

an adhesive disposed between said inner bezel and said panel adjacent the outer periphery of said inner bezel.

10. The glazing system according to claim 1, further comprising:

a bead seal between said outer bezel and said barrier adjacent the outer periphery of said outer bezel.

11. The glazing system according to claim 9, wherein said panel is insulated, and said inner bezel includes a first portion and a second portion substantially perpendicular to one another, said first portion having said adhesive secured thereto, and said second portion extending into said opening.

12. The glazing system according to claim 9, wherein said panel is un-insulated, and said inner bezel includes a body portion with a channel to receive an exposed portion of said fasteners protruding through said panel, a flange extending outwardly from an outer periphery of said inner bezel with said adhesive secured thereto, and a support portion extending from said body portion and toward said impact glazing.

13. The glazing system according to claim 1, further comprising:

a structural sealant disposed between said panel and said impact glazing.

14. The glazing system according to claim 13, wherein said structural sealant is received in said apertures and surrounds said fastener shafts.

15. A method of constructing a glazing system in a barrier comprising:

providing a panel with an opening therethrough;

providing an impact glazing with a plurality of over-sized apertures around its periphery;

positioning said impact glazing, which has an inner surface and an outer surface over said opening;

securing said impact glazing to said panel in said opening with fasteners, wherein each said fastener has a shaft, each fastener shaft extending through a corresponding said over-sized aperture such that a full circumferential gap is formed between said fastener shaft and said impact glazing, each fastener having a fastener head positioned adjacent to said outer surface, wherein an elastic washer is positioned between each said fastener head and said impact glazing;

securing an inner bezel over the periphery of said inner surface of said impact glazing using an adhesive tape positioned between the outer periphery of said inner bezel and said barrier; and securing an outer bezel over said fastener heads and around the periphery of said outer surface of said impact glazing using another adhesive seal positioned between the inner periphery of said outer bezel and said outer surface of said impact glazing.

16. The method of constructing a glazing system according to claim 15, further comprising:

providing a bead seal between said outer bezel and said barrier adjacent the outer periphery of said outer bezel.

17. The method of constructing a glazing system according to claim 15, further comprising:

securing said impact glazing to said panel by inserting said fastener shafts through said apertures from said outer surface of said impact glazing.

18. The method of constructing a glazing system according to claim 15, further comprising:

inserting said fasteners having a shaft diameter less than a diameter of said corresponding aperture so as to form said circumferential gap therebetween.

19. The method of constructing a glazing system according to claim 15, further comprising:

securing said impact glazing to said panel by applying a structural sealant therebetween, wherein said structural sealant is received in said apertures.

* * * * *